US006655237B2

(12) United States Patent
Chen

(10) Patent No.: US 6,655,237 B2
(45) Date of Patent: Dec. 2, 2003

(54) RATCHET WRENCH HAVING COVER POSITIONING DEVICE

(76) Inventor: Yu Tang Chen, No. 111, Lane 699, Guangshing Rd., Taiping City, Taichung (TW)

( * ) Notice: Subject to any disclaimer, the term of this patent is extended or adjusted under 35 U.S.C. 154(b) by 0 days.

(21) Appl. No.: 10/137,308

(22) Filed: May 3, 2002

(65) Prior Publication Data

US 2003/0205113 A1 Nov. 6, 2003

(51) Int. Cl.[7] ..... B25B 13/46
(52) U.S. Cl. ..... 81/60
(58) Field of Search ..... 81/60, 63, 63.2, 81/61, 62, 63.1

(56) References Cited

U.S. PATENT DOCUMENTS 6,230,591 B1 * 5/2001 Ling et al. ..... 81/63
6,260,448 B1 * 7/2001 Chaconas ..... 81/63
6,408,722 B1 * 6/2002 Chen ..... 81/60
6,481,315 B1 * 11/2002 Chang et al. ..... 81/60

* cited by examiner

*Primary Examiner*—Lee D. Wilson
(74) *Attorney, Agent, or Firm*—Rosenberg, Klein & Lee

(57) ABSTRACT

A ratchet wrench having a cover positioning device includes a handle having a receiving recess, a ratchet wheel mounted in the receiving recess of the handle, and a cover mounted in the receiving recess of the handle so as to cover the receiving recess of the handle and the ratchet wheel. The cover has a surface formed with a depression which has an opened side, so that the depression has a stepwise cross-section. A C-shaped snap ring is mounted in the depression of the cover, and has one side selectively locked on a wall of the receiving recess of the handle and an outer periphery of the ratchet wheel.

4 Claims, 7 Drawing Sheets

RATCHET WRENCH HAVING COVER POSITIONING DEVICE

BACKGROUND OF THE INVENTION

1. Field of the Invention

The present invention relates to a ratchet wrench having a cover positioning device, and more particularly to a ratchet wrench having a cover positioning device, wherein the cover may be mounted easily and conveniently.

2. Description of the Related Art

A conventional ratchet wrench in accordance with the prior art comprises a handle having one end formed with a receiving recess, a ratchet wheel mounted in the receiving recess of the handle, and a cover mounted in the receiving recess of the handle, to cover the ratchet wheel, thereby preventing the ratchet wheel from detaching from the receiving recess of the handle. However, the cover mounted in the receiving recess of the handle in a locking manner, so that assembly and disassembly of conventional ratchet wrench is difficult and inconvenient.

SUMMARY OF THE INVENTION

The primary objective of the present invention is to provide a ratchet wrench having a cover positioning device, wherein the cover may be mounted easily and conveniently.

Another objective of the present invention is to provide a ratchet wrench having a cover positioning device, wherein the C-shaped snap ring may be mounted in the depression of the cover and locked in the locking groove of the receiving recess of the handle easily and conveniently, so as to efficiently prevent the cover and the ratchet wheel from being detached from the receiving recess of the handle.

A further objective of the present invention is to provide a ratchet wrench having a cover positioning device, wherein it is easy to form the depression in the surface of the cover, thereby simplifying fabrication of the ratchet wrench.

In accordance with the present invention, there is provided a ratchet wrench having a cover positioning device, comprising a handle having one end formed with a receiving recess, a ratchet wheel mounted in the receiving recess of the handle, and a cover mounted in the receiving recess of the handle, to cover the receiving recess of the handle and the ratchet wheel, wherein:

the cover has a surface formed with a depression, the depression has an opened side, so that the depression has a stepwise cross-section, and a C-shaped snap ring is mounted in the depression of the cover, the C-shaped snap ring has one side selectively locked on a wall of the receiving recess of the handle and an outer periphery of the ratchet wheel.

Preferably, the wall of the receiving recess of the handle is formed with a locking groove for locking the C-shaped snap ring.

Preferably, the outer periphery of the ratchet wheel is formed with a locking groove for locking the C-shaped snap ring.

Preferably, the cover is formed with a through hole to mate with the ratchet wheel, and the depression of the cover is located at an outer periphery of the through hole.

Preferably, the depression of the cover has a semi-circular shape.

Preferably, the depression of the cover has an annular shape.

Further benefits and advantages of the present invention will become apparent after a careful reading of the detailed description with appropriate reference to the accompanying drawings.

DETAILED DESCRIPTION OF THE INVENTION

Figure 1:
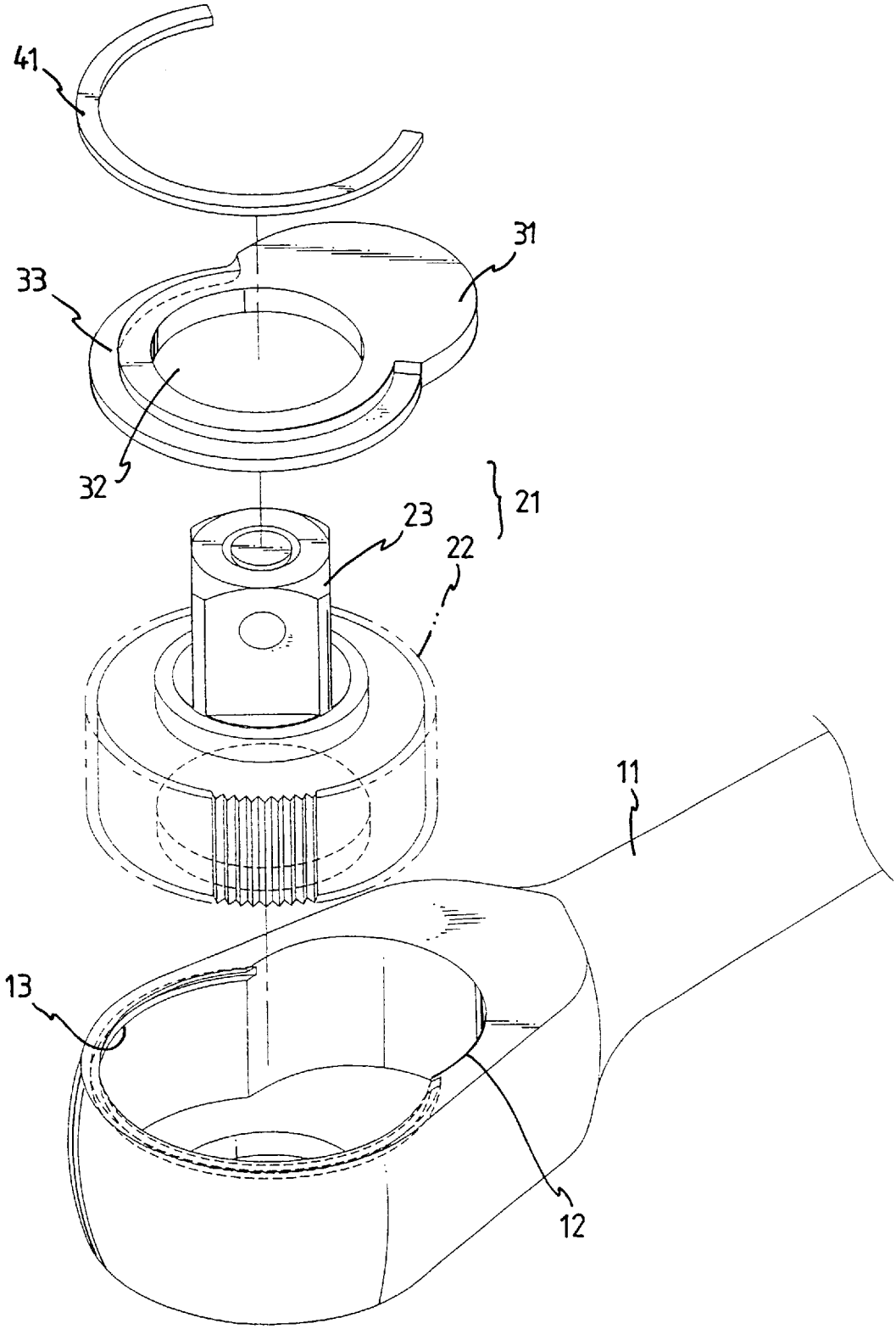
FIG. 1 is an exploded perspective view of a ratchet wrench having a cover positioning device in accordance with a first embodiment of the present invention.

Referring to the drawings and initially to FIG. 1, a ratchet wrench having a cover positioning device in accordance with a first embodiment of the present invention comprises a handle 11, a ratchet wheel 21, a cover 31, and a C-shaped snap ring 41.

The handle 11 has one end formed with a receiving recess 12 which has a wall having a top portion formed with a locking groove 13 as shown in the figure.

The ratchet wheel 21 includes a main body 22, and a shaft portion 23 which is extended from a center of the main body 22 to mate with a socket (not shown).

The cover 31 has a surface formed with a through hole 32. The cover 31 has a periphery formed with a depression 33 located at an outer periphery of the through hole 32. It is appreciated that, the depression 33 has a semi-annular shape, and has an opened side, so that the depression 33 has a substantially L-shaped stepwise cross-section. In addition, in the first embodiment of the present invention, the opened side of the depression 33 is directed toward an outer edge of the cover 31.

Figure 2:
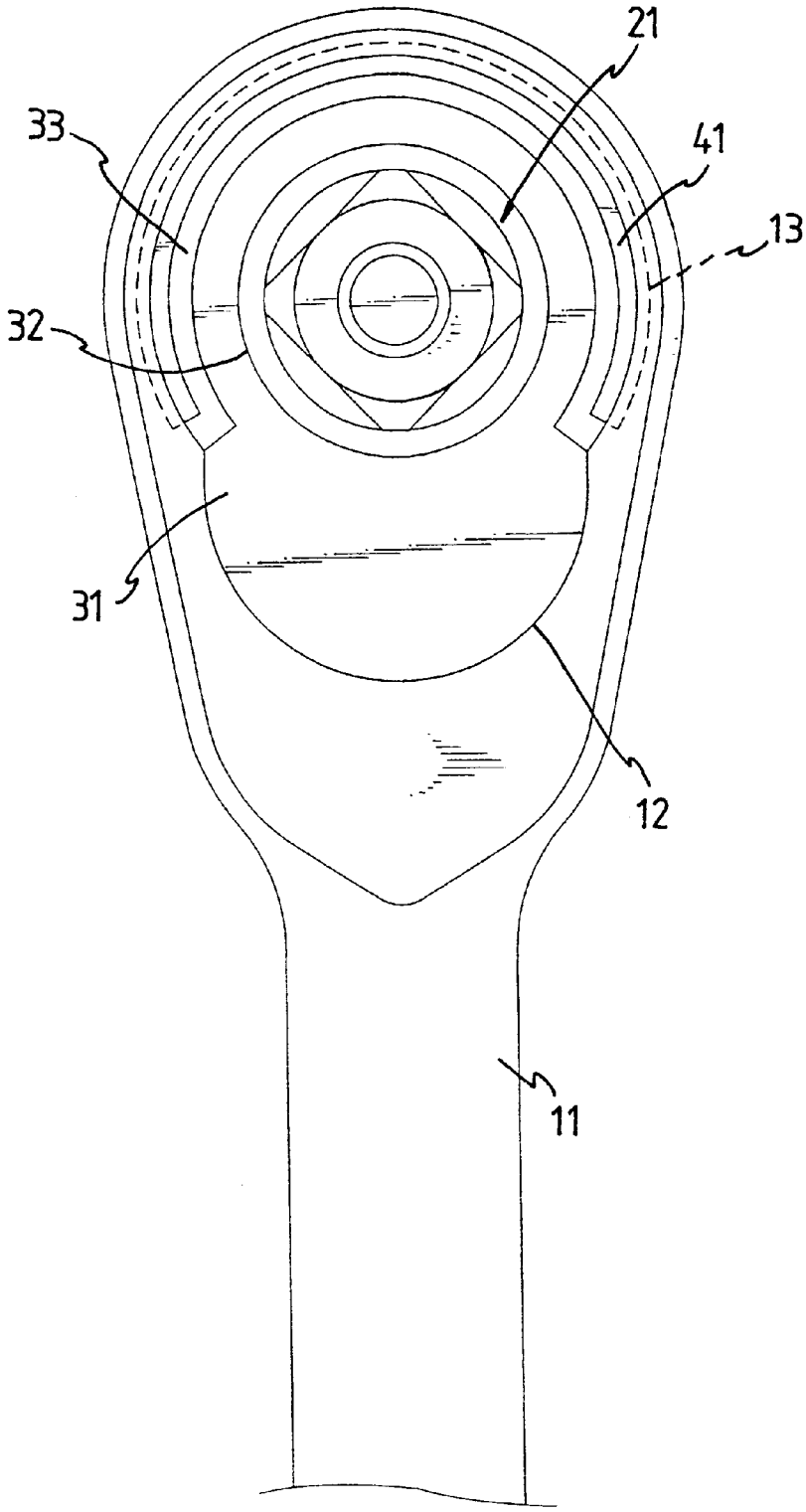
FIG. 2 is a top plan assembly view of the ratchet wrench having a cover positioning device as shown in FIG. 1.
Figure 3:
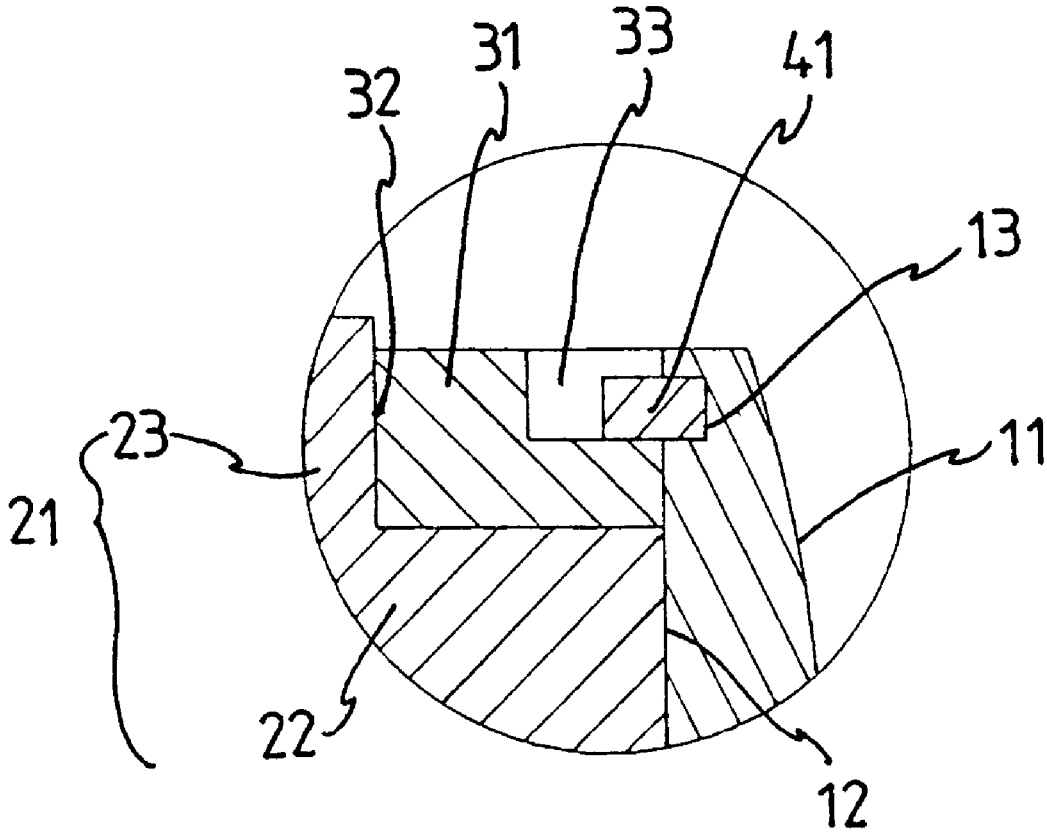
FIG. 3 is a partially cut-away side plan cross-sectional assembly view of the ratchet wrench having a cover positioning device as shown in FIG. 2.

Referring to FIGS. 2 and 3, the ratchet wrench having a cover positioning device in accordance with the first embodiment of the present invention is assembled.

The ratchet wheel 21 is mounted in the receiving recess 12 of the handle 11, and the cover 31 is mounted in the receiving recess 12 of the handle 11. At this time, the shaft portion 23 of the ratchet wheel 21 is protruded outward from the through hole 32 of the cover 31, and the bottom face of the cover 31 is rested on the main body 22 of the ratchet wheel 21.

Then, the C-shaped snap ring 41 is mounted in the depression 33 of the cover 31, and an outer side of the C-shaped snap ring 41 is locked in the locking groove 13 of the receiving recess 12 of the handle 11 by the elastic restoring force of the C-shaped snap ring 41.

Thus, the cover 31 is retained by the C-shaped snap ring 41, and cannot be detached from the receiving recess 12 of the handle 11, so that the ratchet wheel 21 cannot be detached from the receiving recess 12 of the handle 11. Thus, the C-shaped snap ring 41 may be locked in the locking groove 13 of the receiving recess 12 of the handle 11 easily and conveniently, so as to efficiently prevent the cover 31 and the ratchet wheel 21 from being detached from the receiving recess 12 of the handle 11. In addition, it is easy to form the depression 33 in the surface of the cover 31, thereby simplifying fabrication of the ratchet wrench.

Figure 4:
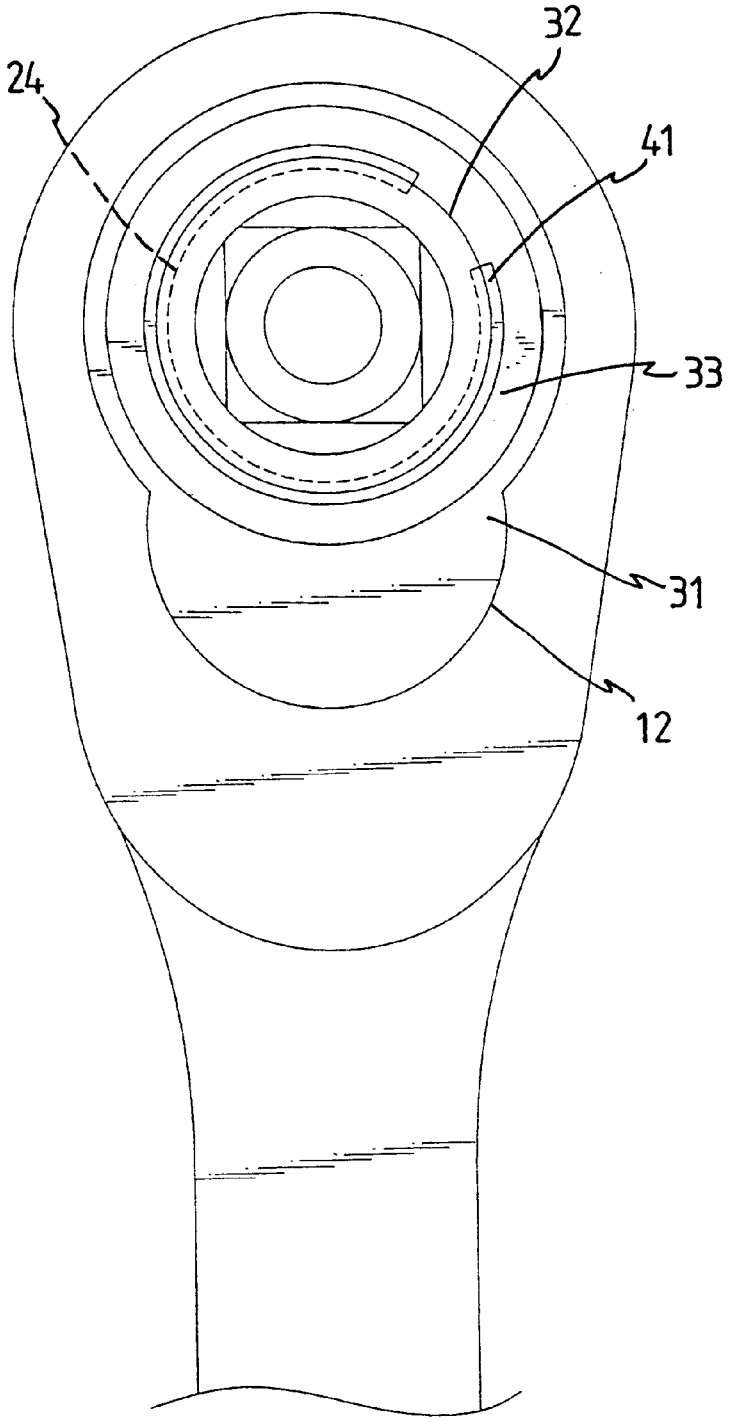
FIG. 4 is a top plan assembly view of a ratchet wrench having a cover positioning device in accordance with a second embodiment of the present invention.
Figure 5:
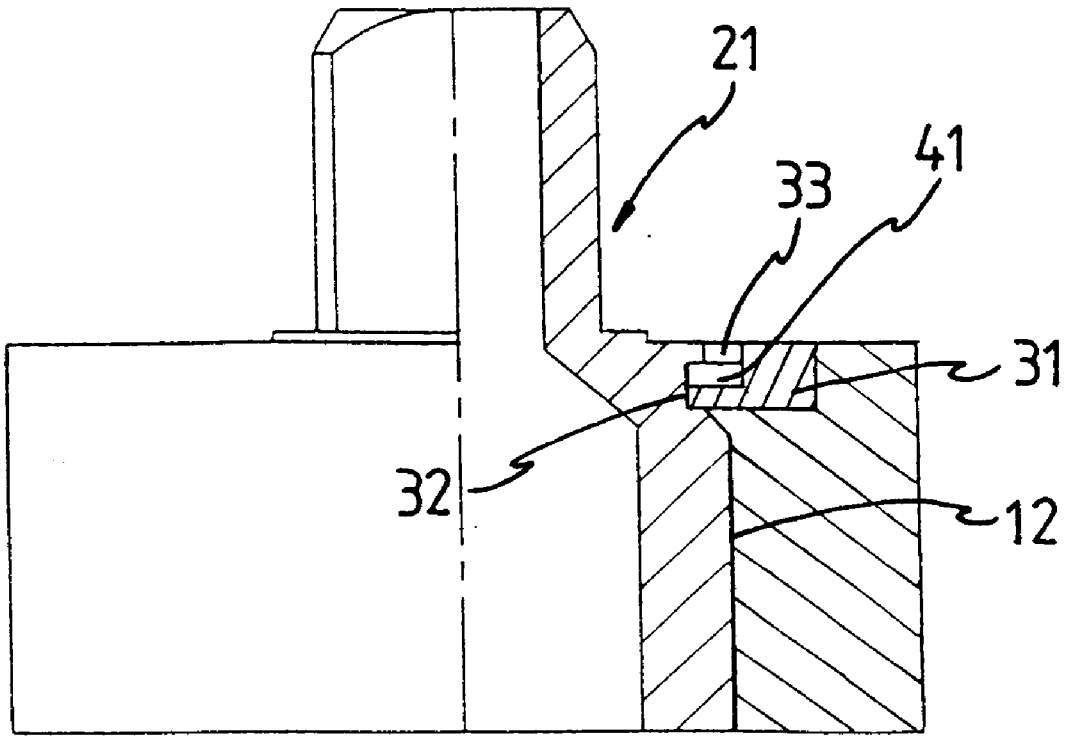
FIG. 5 is a partially cut-away side plan cross-sectional assembly view of the ratchet wrench having a cover positioning device as shown in FIG. 4.

Referring to FIGS. 4 and 5, a ratchet wrench having a cover positioning device in accordance with a second embodiment of the present invention is shown.

As shown in the figures, the receiving recess 12 of the handle 11 is provided with a ratchet wheel 21 which is fixed in the receiving recess 12 of the handle 11, and the cover 31 is mounted in the receiving recess 12 of the handle 11 to cover and seal the receiving recess 12 of the handle 11.

It is appreciated that, the cover 31 has a periphery formed with a depression 33, and the opened side of the depression 33 is directed toward the through hole 32 of the cover 31. Thus, the C-shaped snap ring 41 is mounted in the depression 33 of the cover 31, and an inner side of the C-shaped snap ring 41 is locked in a locking groove 24 that is formed in an outer periphery of the ratchet wheel 21. Thus, the cover 31 may be retained by the C-shaped snap ring 41, and cannot be detached from the receiving recess 12 of the handle 11, so that the ratchet wheel 21 cannot be detached from the receiving recess 12 of the handle 11.

Figure 6:
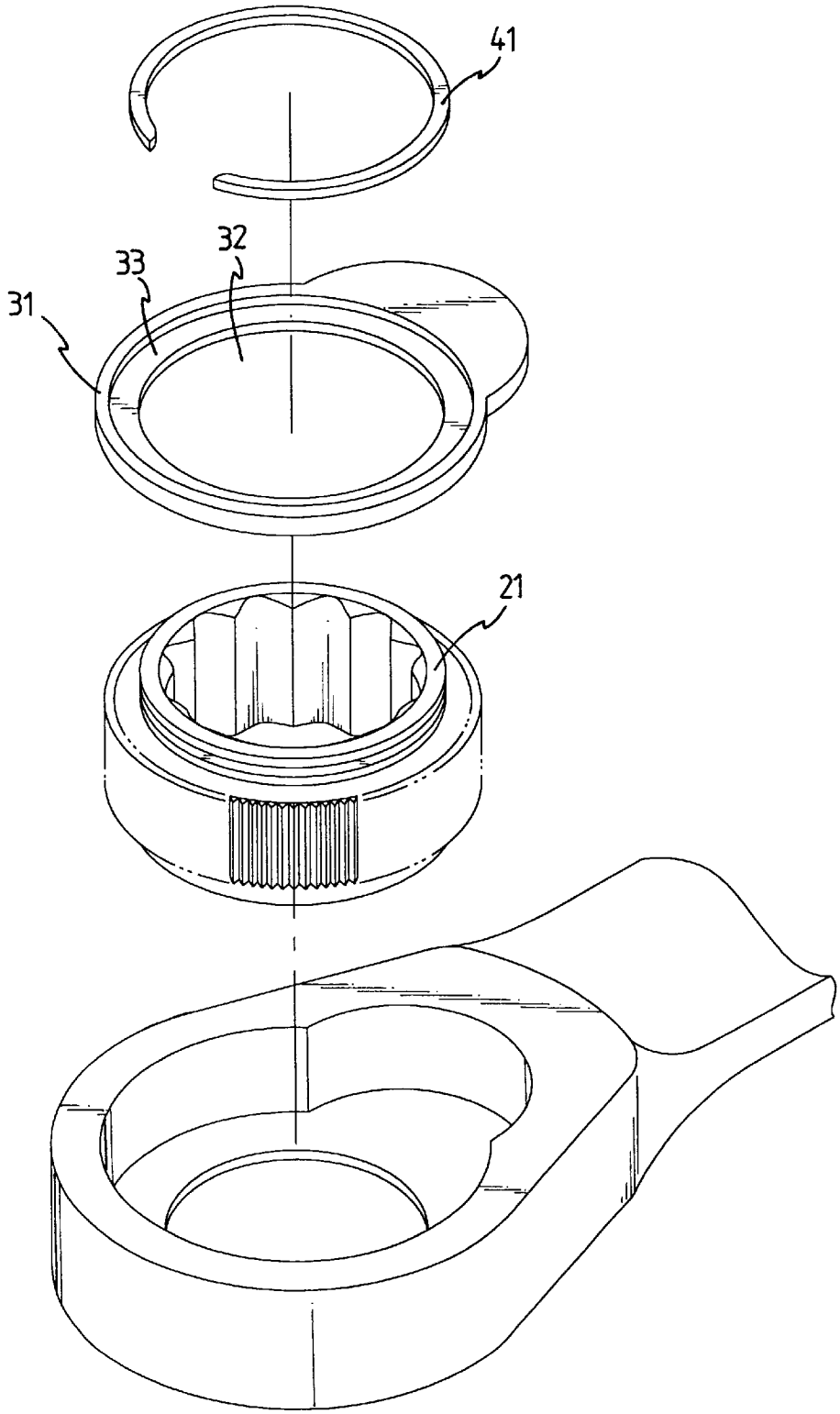
FIG. 6 is an exploded perspective view of a ratchet wrench having a cover positioning device in accordance with a third embodiment of the present invention.
Figure 7:
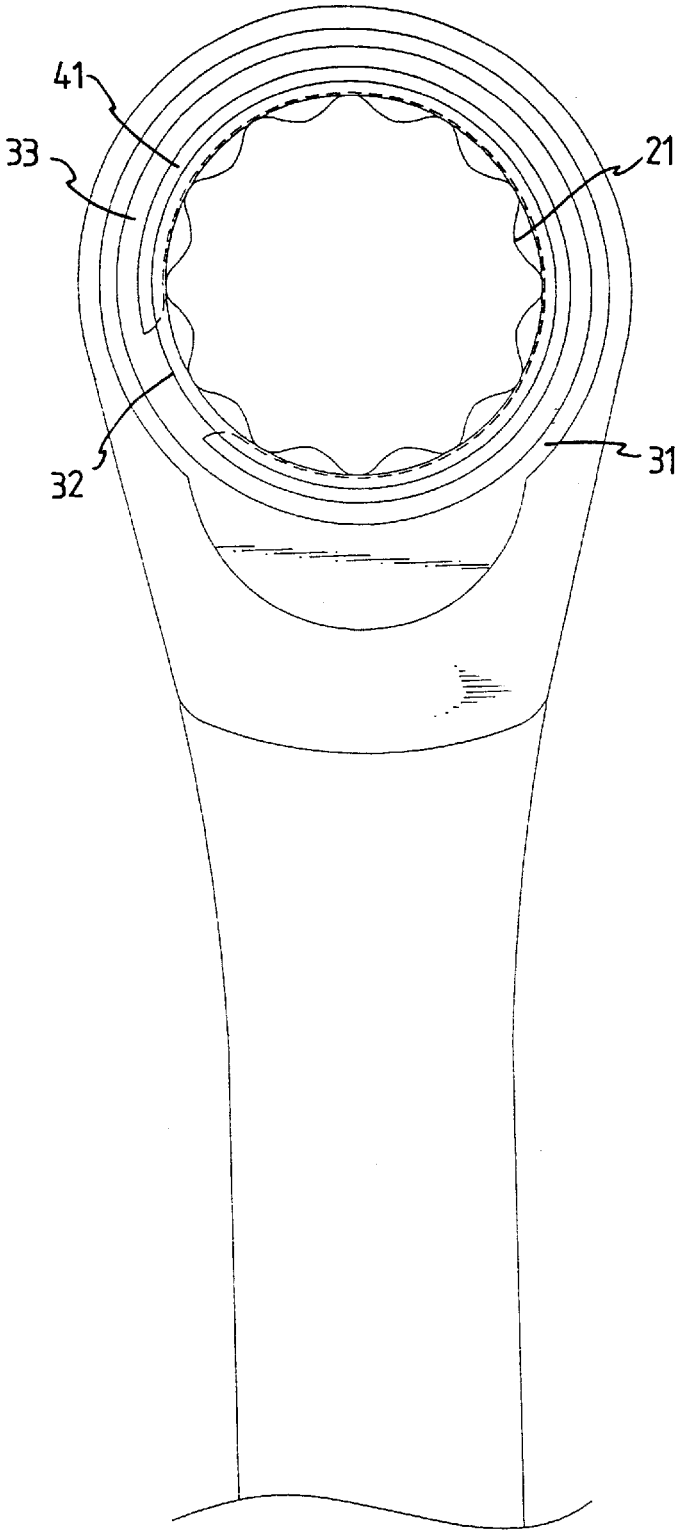
FIG. 7 is a top plan assembly view of the ratchet wrench having a cover positioning device as shown in FIG. 6.

Referring to FIGS. 6 and 7, a ratchet wrench having a cover positioning device in accordance with a third embodiment of the present invention is shown, wherein the ratchet wheel 21 has a closed shape.

As shown in the figures, the cover 31 has a periphery formed with a depression 33, and the opened side of the depression 33 is directed toward the through hole 32 of the cover 31. The depression 33 of the cover 31 has an annular shape.

Thus, the C-shaped snap ring 41 is mounted in the depression 33 of the cover 31, and an inner side of the C-shaped snap ring 41 is locked on an outer periphery of the ratchet wheel 21. Thus, the cover 31 may be retained by the C-shaped snap ring 41, and cannot be detached from the receiving recess 12 of the handle 11, so that the ratchet wheel 21 cannot be detached from the receiving recess 12 of the handle 11.

Accordingly, in the ratchet wrench having a cover positioning device in accordance with the present invention, it is easy to form the depression 33 in the surface of the cover 31, thereby simplifying fabrication of the ratchet wrench. In addition, the C-shaped snap ring 41 may be mounted in the depression 33 of the cover 31 and locked in the locking groove 13 of the receiving recess 12 of the handle 11 easily and conveniently, so as to efficiently prevent the cover 31 and the ratchet wheel 21 from being detached from the receiving recess 12 of the handle 11.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A ratchet wrench comprising:

a handle having one end formed with a receiving recess, a ratchet wheel mounted in the receiving recess of the handle, and a cover mounted in the receiving recess of the handle, to cover the receiving recess of the handle and the ratchet wheel;

the cover having a surface formed with a depression having a semicircular shape, the depression having an opened side and a stepwise cross-section, a C-shaped snap ring being mounted in the depression of the cover, the C-shaped snap ring having one side selectively locked on a wall of the receiving recess of the handle and an outer periphery of the ratchet wheel.

2. The ratchet wrench in accordance with claim 1, wherein the wall of the receiving recess of the handle is formed with a locking groove for locking the C-shaped snap ring.

3. The ratchet wrench in accordance with claim 1, wherein the outer periphery of the ratchet wheel is formed with a locking groove for locking the C-shaped snap ring.

4. The ratchet wrench in accordance with claim 1, wherein the cover is formed with a through hole to mate with the ratchet wheel, and the depression of the cover is located at an outer periphery of the through hole.

* * * * *